United States Patent [19]

Gietman, Jr.

[11] Patent Number: 4,667,890

[45] Date of Patent: May 26, 1987

[54] CORELESS WINDER

[75] Inventor: Peter J. Gietman, Jr., Combined Locks, Wis.

[73] Assignee: Custom Machinery Design, Inc., Appleton, Wis.

[21] Appl. No.: 755,100

[22] Filed: Jul. 15, 1985

[51] Int. Cl.[4] ..... B65H 18/00; B65H 75/22

[52] U.S. Cl. ..... 242/55; 242/72.1; 242/74

[58] Field of Search ..... 242/55, 56 R, 56 A, 242/72 R, 72.1, 74, 66

[56] References Cited

U.S. PATENT DOCUMENTS

| | | | |
|---|---|---|---|
| 3,244,380 | 4/1966 | Hoyne | 242/72.1 X |
| 4,002,308 | 1/1977 | Feighery | 242/56 R X |
| 4,389,868 | 6/1983 | Strout | 242/56 R X |

*Primary Examiner*—Stuart S. Levy
*Assistant Examiner*—David Werner
*Attorney, Agent, or Firm*—John C. Cooper, III; Fred Wiviott

[57] ABSTRACT

A winder for winding pliable material into coreless rolls includes a conveyor for bringing the material into proximity with a turret. The turret includes a plurality of spindles upon which the material is to be wound. Transfer of the material to the spindle is accomplished by a cluster of rollers which surround an individual spindle at the time of transfer. Ropes or belts pass around the rollers to assist in guiding the pliable material. An air blast also assists in the transfer. At least one of the rollers is pivotable from a first position to a second position. An empty spindle is brought into the transfer position during turret indexing. The system of the present invention also includes a collapsible spindle to facilitate removal of the finished roll. The diameter of the spindle is decreased as a push-off palm removes the roll from the spindle and is increased during retraction of the palm to prepare the spindle for attachment of the leading edge of the next roll.

19 Claims, 8 Drawing Figures

CORELESS WINDER

BACKGROUND OF THE INVENTION

1. Field of the Invention

The present invention relates generally to the art of winding equipment. More specifically, it relates to equipment for winding strips of elongate, pliable material, such as paper or plastic, into coreless rolls. Still more specifically, the preferred embodiment of the present invention relates to equipment for winding a strip of plastic bags into coreless rolls.

2. Description of the Prior Art

Equipment for winding material into core-containing and coreless rolls is well known in the art. For purposes of illustrating such prior art, one particular type of coreless plastic bag winder will be described, i.e., a winder for plastic garbage or trash bags, kitchen wastebasket liners, food storage bags, etc.

In such prior art winder, a continuous strip of bags is fed to the winder, and the winder prepares coreless rolls therefrom. The bags themselves are produced in upstream bag making equipment which will be only briefly described because the method of making the bags is not critical to the present invention.

In most conventional bag making equipment a tube of plastic film is extruded through an extruding die, and the tube is then flattened before it enters the bag machine. In the bag machine the film is sealed across its width to form the bottom of the finished product. The open top of the bag can be formed in two different types of bag machines. The first is to simply cut the bag. In this type of bag machine, individual bags are formed which are typically folded and placed into suitable packaging for the individual or institutional consumer. In the other type of bag machine, the top is formed by perforating the bag across its width. The bag is then folded longitudinally, either before or after the perforation step, to provide a continuous strip of connected and folded bags. Such bags are then wound into a core-containing or a coreless roll. It is the latter type of bag machine with which the winder of the present invention is particularly useful.

The winder which is most similar to the winder of the present invention is the winder which has been sold by Custom Machinery Design, Inc. of Little Chute, Wisconsin for the past few years. That winder will be described in some detail here. Such winder includes a dancer mechanism to sense the tension of the strip of bags being fed to the winder, the dancer mechanism including a connection to the winder drive motor, whereby the speed of the winder can be "slaved" to the output speed of the upstream bag making equipment.

The prior art winder also includes haul-off nip rollers, to feed the strip into the winder, and an interrupt section to periodically break the perforations between certain bags in the strip. The frequency of the interruption is determined by the number of bags to be included in each roll. For example, if the roll is to contain twenty bags, the interrupt section will break every twentieth perforation.

Downstream of these sections, the prior art winder includes a three-spindle turret assembly. The winder is designed so that the leading end of one strip of bags is attached to a first spindle when the turret is in a first position. The turret then rotates 120° so that the first spindle is in a second position where the strip is wound into a coreless roll. Following completion of the roll winding, the turret rotates again to a removal station where the roll is pushed off the first spindle by a push-off palm for subsequent packaging. While one roll is being started, a second roll is being wound and a third roll is being removed, etc.

Several other features of the prior art winder should be mentioned here. First, the spindles of the machine are tapered and include a plurality of air holes through which air can be selectively injected. The taper and air injection assist in the removal of the coreless roll. Second, a belt is provided below the turret which includes a movable nose roll. The roll being wound on the spindle stays in contact with the belt to improve the quality of the rolled product, and as the diameter of the roll increases during winding, the belt moves to accommodate roll expansion. This bottom belt is just one of a series of bottom belts used in the prior art machine from the inlet to the outlet of the winder.

While the above-mentioned prior art winder represents a significant improvement over earlier winders for plastic bags, several drawbacks exist. One drawback is the method by which the leading end of a strip of bags is attached to a spindle. This has been accomplished by employing an air horn, kick-roll mechanism. The kick-roll is a pneumatic activated roller located beneath a traveling belt at the area near the transfer location. At the time of transfer, the roller would be extended by a piston rod to quickly push against the belt to "flip" the leading edge of the strip of bags up into the air above the lower belt. At the same time, an air horn would descend around the spindle, the air horn being a half-cylinder containing air ports on one edge. The combination would direct the leading edge of the bag strip around the spindle and tuck it into its own nip to create the attachment. This system, while being better than earlier systems, suffers from drawbacks including complicated hardware (i.e., the kick-roll mechanism and air horn). Moreover, because of the high speeds utilized in my prior art machines, if the air horn, kick-roll system failed to properly attach the moving plastic web to the spindle, a great deal of waste would occur before the next strip would arrive at the transfer position.

Another drawback of the prior machine relates to the spindles themselves and the need to have a complex air supply system for each. Moreover, because the spindle is critical to the integrity of the roll, any tendency of the roll to stick on the spindle or any failure of the air supply system would also lead to waste, or finished products of undesirable quality.

Finally, the prior art machine is fairly large, primarily because of the traveling belt systems and the mechanism required for the air horn, kick-roll combination.

A winder which overcomes the aforementioned disadvantages of the prior art winder would represent a significant advance in the art.

OBJECTS AND SUMMARY OF THE INVENTION

It is a primary object of the present invention to provide a winder which overcomes the above-noted disadvantages of the prior art.

Another object of the invention is to provide a winder having an improved system for attaching the leading edge of a moving film strip to a spindle.

A further object of the present invention is to provide a winder which is smaller in size than the prior art winder.

How these and other objects of the invention are accomplished will be described in the following specification, taken in conjunction with the drawings. Generally, however, they are accomplished with a winder which includes a single bottom support web extending from the winder inlet to the nose roll. The web is formed from a series of notched rollers over which a plurality of spaced-apart ropes are wound. The transfer mechanism includes a pair of fixed rollers and a pivotable roller, which together form a transfer cluster. These rollers are connected by ropes so that they can be selectively rotated to effect a transfer. The pivotable roller is movable from a first position in which it and the other two rollers lie in approximately a straight line to a second position in which it and the other two rollers define a generally triangular cluster. Turret rotation occurs while the pivotable roller is in its first position, and web transfer occurs when the pivotable roller is in its second position. A transfer air pipe is provided to urge the leading edge of the film into the triangular cluster. Another feature of the present invention is a collapsible spindle which replaces the tapered, air-blast type of spindles of the prior art. The spindle is composed of a pair of elongate semi-circular shells and a shaft body which supports the shells. The spindle includes a mechanism to allow the distance between the shell halves to be increased or decreased at the appropriate time. The shells are in an expanded configuration during web transfer and the winding of the strip onto the spindle. The shells are collapsed to a smaller diameter during roll removal. Other ways in which the objects of the invention are accomplished will be described in the following description of the preferred embodiment.

DESCRIPTION OF THE DRAWINGS

FIG. 5 is a side elevation of collapsible spindle employed in the preferred embodiment of the present invention, with its two shell positions being illustrated in full and broken line;

FIG. 6 is a view taken along the line 6-6 of FIG. 5 illustrating a part of the collapsing mechanism. Like reference numerals are used in the various drawings to illustrate like components.

Like reference numerals are used in the various drawings to illustrate like components.

DESCRIPTION OF THE PREFERRED EMBODIMENT

While the present invention will be illustrated with reference to its use as a winder for strips of plastic bags, it should be understood at the outset that the winder can also be employed for winding other pliable materials, such as paper or plastic. The only requirement for the material being wound is that it have sufficient tear strength to be able to withstand the winding forces imposed at the transfer and surface-wind stations. For example, plastic sheeting, paper and tissue products and the like could be wound using the winder of the present invention after appropriate modification, which would be readily apparent to one skilled in the art after reading the present disclosure.

Figure 1:
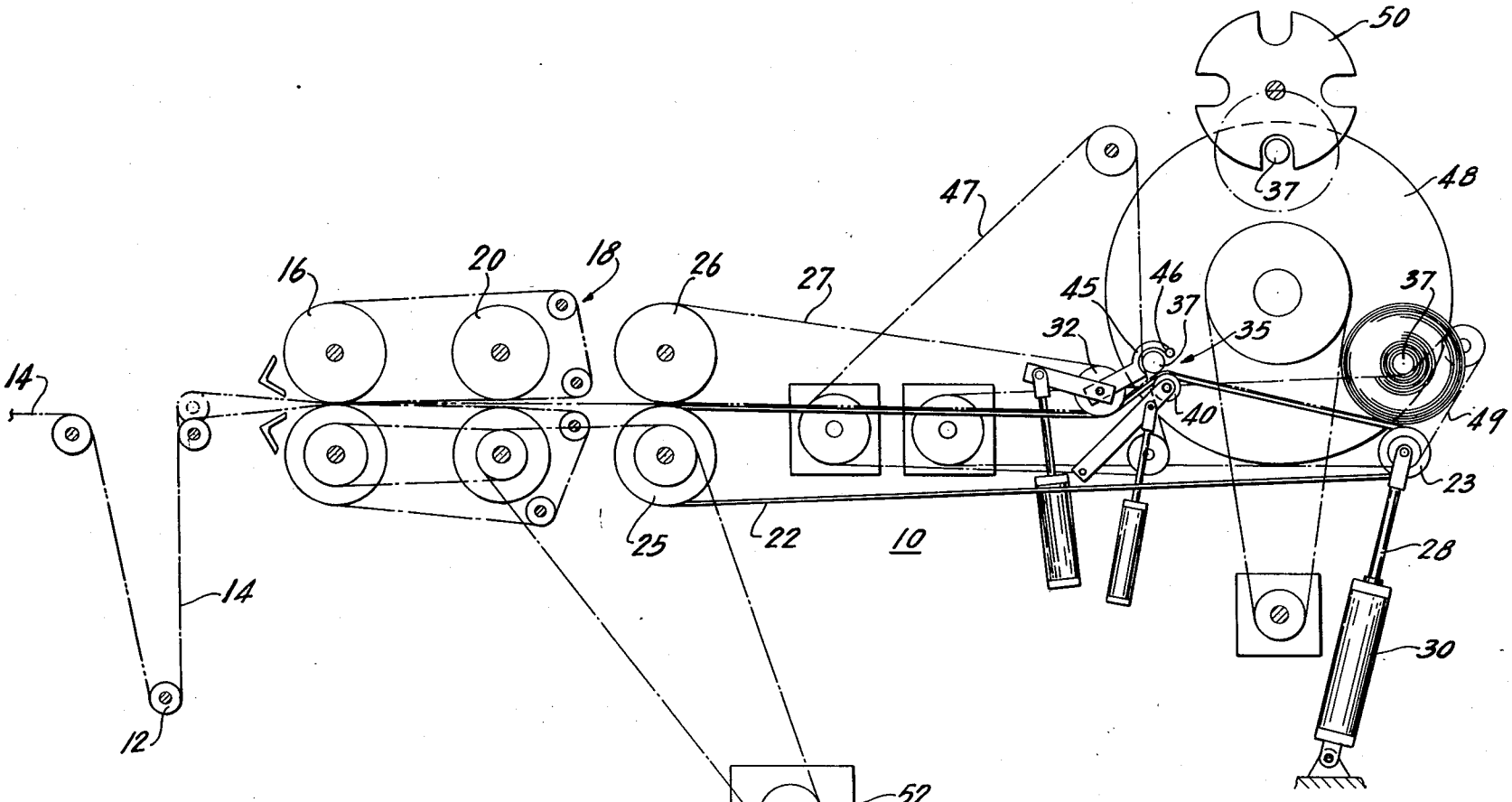
Fig. 1 (PRIOR ART)
FIG. 1 is a schematic-illustration of the prior art winder described earlier in this specificcation.

Proceeding now to the description of FIG. 1, the prior art winder discussed earlier in the specification is shown in schematic form. Winder 10 includes a dancer assembly 12 for sensing the tension in the incoming strip 14 of connected, sealed and at least partially-perforated plastic bags. As mentioned previously, the dancer is connected to a potentiometer (not shown) so that the winder speed can be "slaved" to the speed of the upstream bag machine.

The film enters winder 10 through a pair of haul-off rolls 16 which each include a plurality of annular notches. The notches in turn support a plurality of elastic ropes, e.g., nylon ropes, so that the film is supported across its top and bottom. Downstream of the haul-off rollers is an interrupt section 18. This section also includes a pair of rollers with ropes, the bottom one of which is driven at the winder line speed. The spaced-apart roller 20 at the top of section 18 is driven at a faster speed (about 17% faster) and is spaced slightly above the moving web. By appropriate control, the interrupt roller 20 periodically comes into contact with the bottom moving web, and the differential speed of the top and bottom rollers causes a tear of the perforations connecting two bags. Interrupt section 18 then creates a strip of strip of connected bags to be eventually wound into a coreless roll.

The next component of the prior art winder 10 is a bottom belt 22 which extends from the area of interrupt section 18 to a nose roll 23. Belt 22 is solid across its width and is constructed of any suitable belt material, such as rubber or fabric. In FIG. 1, the belt 22 is driven by conveyor nip roller 25 (which in turn is suitably coupled to the upstream drive components). A top conveyor nip roller 26 is provided with grooves to accept further elastic ropes 27 whereby the film traveling along this section is maintained under proper control and is prevented from becoming airborn at the high speeds used with such equipment.

The nose roll 23 is mounted on a piston rod 28 which allows the nose roll to be pushed downwardly as the winding roll of bags grows in diameter. The nose roll 23 is maintained in contact with the winding roll of bags by a pneumatic air cylinder 30 which is adjustable for pressure by a diaphragm operated air regulator (not shown). The upper elastic belts 27 are returned by a roll 32 on the transfer section 35 now to be described.

At the point of transfer, the leading edge of the new bag strip must be attached to a spindle 37. In winder 10 such transfer is initiated by bringing the edge adjacent to the spindle using a kick-roll 40 mounted below the upper flight of bottom conveyor belt 22 and slightly behind the centerline of the spindle. A rapid elevation of roll 40 causes the belt 22 to make an upward curve around the bottom part of spindle 37. The leading edge of film then shoots up that curve at an angle of approximately 45°. An air horn mechanism 45, in the meantime, has descended over spindle 37 to encircle its top half. Air horn 45 is equipped with a small air pipe 46 having a series of small holes. As the film shoots upwardly, an air blast from pipe 46 directs the film around the spindle 37, forcing the leading edge to follow the curvature of the air horn 45. The leading edge is then directed into its own nip.

Spindle 37 is rotated at a speed which exceeds that of the film speed by spindle drive belt 47 so that a tight winding of the inside wraps is accomplished. As soon as the transfer is completed, the kick-roll 40 lowers and the air horn mechanism 45 swings out of the way. The turret 48 supporting three spindles 37 indexes counterclockwise by 120°. The spindle 37 to which the attachment was made is now located in its final wind position. It should be understood that the winding roll is maintained in contact with belt 22 during turret rotation. When the counter (not shown) indicates that the correct number of bags has been wound on a spindle 37, the sequencing begins again, i.e., a transfer is made at the transfer station, the turret rotates, etc. At this point, the finished roll is moved 120° to the roll removal position. The push-off system includes a geneva-type plate 50, a cylinder (not shown) connected thereto and an air system to inject air into the holes in spindle 37 to "float" the roll off the spindle. When the palm plate 50 reaches its outward position, a magnetic reed switch (not shown) reverses the cylinder, and the plate 50 is returned to its original position, thus preparing an empty spindle for repetition of the cycle. The rolls pushed off the turret 48 by palm plate 50 may be collected in any suitable manner for packaging in a box or a plastic sleeve. The packaging system may be of any type known to the art and will not be described here.

The electrical sequencing of winder 10 is unique since no use is made of timers. It will be described briefly here. The precise timing of all systems is derived from a counter system (not shown). A gear is placed on the bag making machine and it makes one revolution with each bag produced. A second magnetic pick-up head is used to signal the bags-per-roll counter for every bag produced by the bag making machine. The bags-per-roll counter may be programmed by the operator for the number of bags per roll required. When the correct amount of bags have been wound, the counter produces an electrical impulse signal, and this signal starts the interrupt start and interrupt stop counters and also the transfer start and transfer stop counters. As those four counters are started, they take into account the teeth count signal from the gear pick-up head. Since all the distances in the winder are fixed, i.e., the distances from the perforation section in the bag machine to the interrupt section 18 of the winder, and the distance from the interrupt section to the transfer section, it does not matter what speed changes occur since the "timing" is done by distance only. A certain amount of "counts" of the gear pick-up head will bring the perforation from the perforating section to the interrupt section 18 and when this count is reached by the interrupt start counter, the interrupt roller 20 comes down to tear the perforations apart. The interrupt stop counter raises roller 20 when the counts are reached on that counter, the transfer start counter reaches its preset counts and the kick-roll comes up, the air horn comes down, the air blast occurs, etc. When the transfer stop counter reaches its preset, these systems deactivate. Also, when the transfer stop counter reaches its preset, the counter signals the index system and the turret indexes. There is a limit switch on the turret which signals the push-off mechanism that the turret is in the proper position for the push-off to occur. Also, the push-off cylinder has to be in the retracted, or ready, position before the next transfer system can be activated. This safety system assures that the air horn is retracted before the turret can index, to prevent accidental damage to the mechanical system. The turret indexing comes from a one-revolution- per-index clutch and brake system, so that when a signal is received to make an index, a solenoid operated lock pawl retracts and allows this clutch to make one index and stop again. Since the turret only indexes 120°, a 3:1 ratio drive is utilized. Also, a safety torque timer system is installed in the turret index drive to prevent any damage to the system should there be a jam-up. Another feature of the prior art winder is a reset circuit which allows the operator to reset a transfer regardless of the amount of bags on the winding roll. The main drive motor 52 of this winder is a standard A-C motor operated at variable speed through an A-C inverter system.

Figure 2:
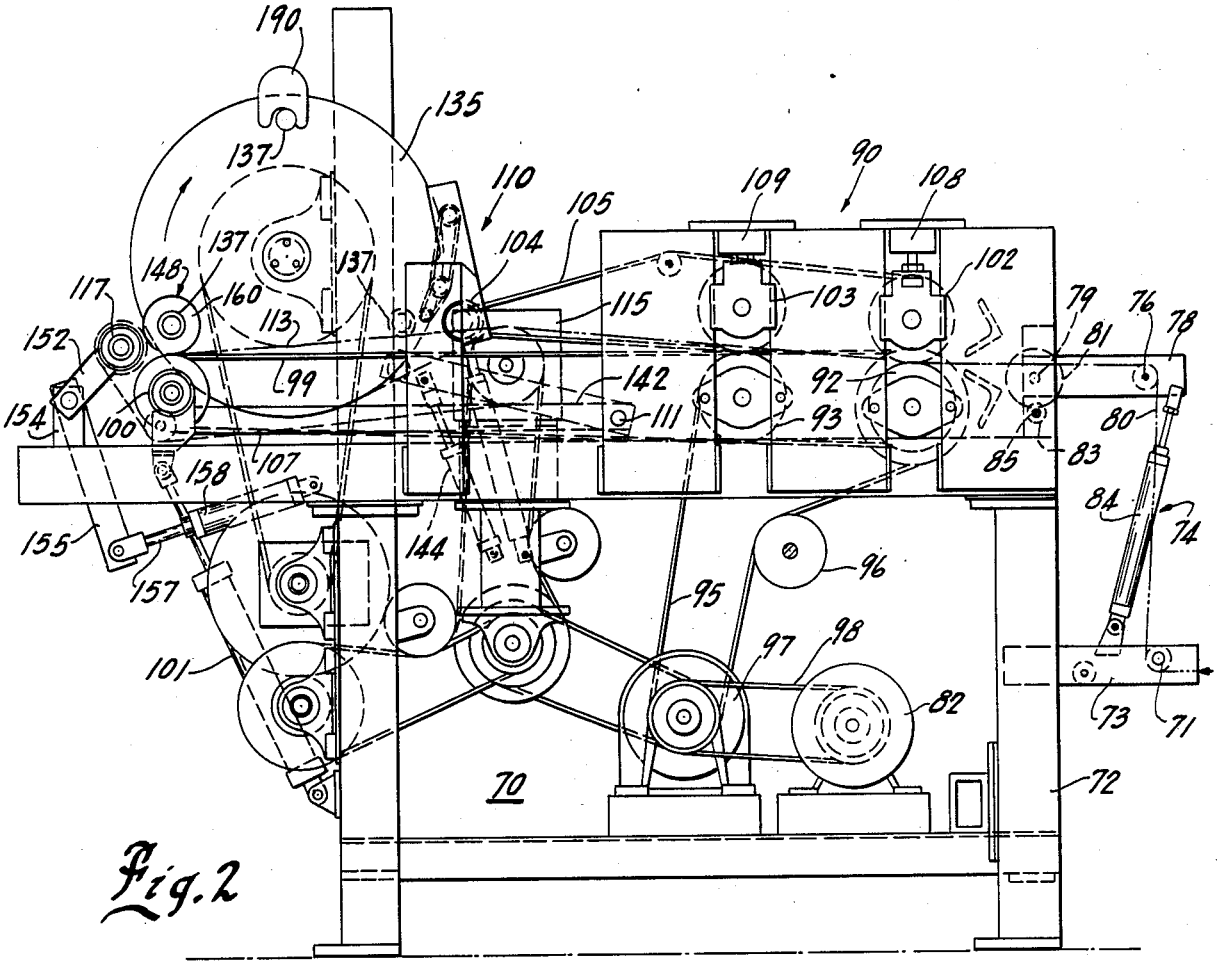
FIG. 2 is a side elevation of the winder according to the preferred embodiment of the present invention.

Proceeding now to the description of the preferred embodiment of the present invention, a winder 70 is shown in side elevation in FIG. 2. Winder 70 includes a frame 72 and a dancer mechanism 74. Dancer mechanism 74 includes an inlet roll 71 mounted to a plate 73 and a free running roll 76 mounted in suitable bearings to a set of parallel and spaced-apart swing arms 78. Swing arms 78 are, in turn, mounted to a shaft 79. As the tension in the incoming film 80 changes, a rotation of the swing arm shaft occurs. A gear 81 on such shaft engages a gear 83 on a potentiometer 85 which is designed to alter the speed signal to drive motor 82. The mean speed of the winder motor 82 comes from the bag machine motor speed. It is necessary to build in some adjustment factor to compensate for the fact that plastic films may stretch. In winder 70 this is accomplished by the dancer potentiometer which overrides the line speed system by up to 5%.

Tension in the film felt by the dancer roll 76 may be adjusted through an air cylinder 84 mounted between plate 73 and swing arms 78. Cylinder 84 is regulated for pressure in cylinder 84, and thus the tension felt by the dancer system 74 will be determined by the type of plastic film being processed. Typically, thin gauge film or weak perforations between the bags in strip 80 will require less air pressure to cylinder 84, while the reverse will be the case if a heavier gauge of film is being used or strong perforations exist between the bags.

The strip 80 of bags next enters the winder feed roll and interrupt section 90 which includes a pair of spaced-apart bottom rollers 92 and 93 driven by a belt 95 coupled to pulleys on the rollers. Belt 95 is driven from a pulley on a gear reducer 97 which in turn is coupled to motor 82 by belt 98. A tensioning roll 96 is provided to ensure that slippage of belt 95 does not occur during operation of winder 70. Bottom rollers 92 and 93 are grooved at spaced intervals across their width to accommodate a plurality of nylon elastic ropes 99. The ropes 99 may be made of any other suitable material and a plurality of belts could be used as well. A third roller 100 (the nose roller) is located at the downstream end of winder 70 and it also includes similar grooves. Roller 100 is coupled to swing arms 107 which are mounted to pivot 111, and a pneumatic cylinder 101 in a manner similar to that employed for the nose roll 23 of the prior art winder 10. Ropes 99 then travel along the length of winder 70 and form the bottom conveying surface for the plastic film.

Feed roll and interrupt section 90 also includes a top rope section formed by three rollers 102, 103 and 104. Roller 102 is located above roller 92 and is driven by gears coupling the shafts of rollers 92 and 102. Roller 103 is spaced slightly above roller 93. Roller 104 is an idler roller located downstream of section 90. These latter three rollers also include grooves to accept ropes 105. The top ropes 105 are necessary to prevent the thin plastic film from becoming airborn at the high film speeds used in winder 70. Roller 102 is maintained in pressure contact with roller 92 by a pneumatic cylinder 108 mounted above roller 102. The nip then, between these two rollers, feeds the film into winder 70. Rollers 103 and 93 serve as the interrupt section. Roller 103 is driven by gears coupling rollers 103 and 93, rollers 103 and 93 are driven at a surface speed which exceeds that of the film by approximately 17%. Roller 103 is normally in an up position so that it does not nip or make contact with bottom roller 93. Another pneumatic cylinder 109 is coupled to roller 103 and is arranged to periodically lower roller 103 so that it does nip at the overspeed condition. While in the normal or up position, the film entering the winder 70 is allowed to move downstream at normal line speed. When, however, the correct amount of bags has passed beneath roller 103, a signal will cause extension of the piston rod of cylinder 109. Because of the overspeed of rollers 93 and 103, the perforation between the last bag of the downstream strip will be torn apart from the first bag of the next strip. The overspeed also causes a separation of the bags, following which the interrupt roller 103 is pneumatically raised to allow the leading edge of the following strip to pass downstream in winder 70.

Figure 3:
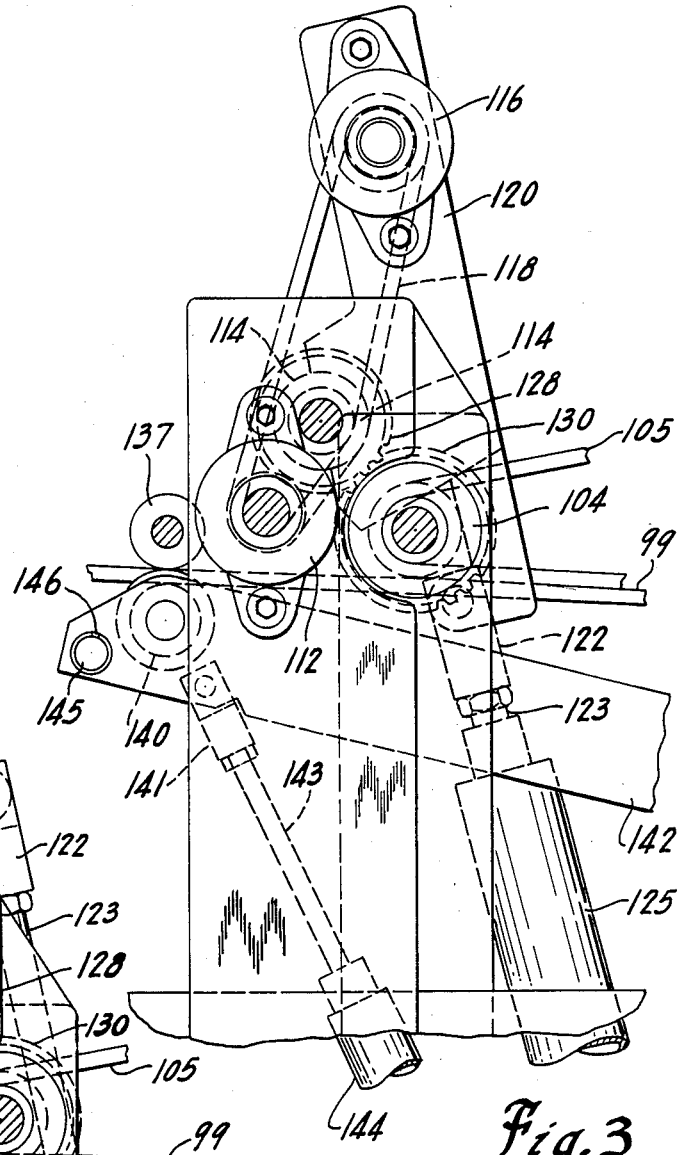
FIG. 3 is a side detail view of the transfer cluster showing a first position for the roller.

The transfer section 110 of winder 70 is located downstream of section 90 and will be explained by reference to FIGS. 3 and 4. The transfer section includes three smaller rollers 112, 114 and 116, each of which includes annular grooves to receive drive ropes 118. Rollers 112 and 114 are fixed in the winder frame 72 above the upper surface of ropes 99. Roller 112 is located just above ropes 99, and roller 114 is located above roller 112. Both rollers are located just to the left of the idler roll 104. The third roller 116, on the other hand, is movable between the positions shown in FIGS. 3 and 4. Such movement is made possible by mounting roller 116 to a first end of a swing arm 120, the middle portion of which is pivotable about the shaft used to support the middle roller 114. The other end of swing arm 120 is coupled to a clevis 122 threaded onto the end of a piston rod 123 of a pneumatic cylinder 125. From this description, it will be apparent that extension of the piston rod 123 will cause the swing arm 120 to pivot about the axis of the middler roller shaft to change the orientation of the group of transfer rollers from the nearly linear arrangement of FIG. 3 to the triangular arrangement of FIG. 4.

The middle roller 114 also includes a drive capability because a gear 128 is provided on its shaft. Gear 128 meshes with a gear 130 on the shaft of the idler roller 104 and rotation of these two gears is controlled by a clutch (not shown) on the shaft of roller 104 to selectively drive rollers 112, 114 and 116, with their associated ropes 118 as and when needed.

Located downstream of the transfer section 110 is a turret 135 which includes three spindles 137 located at 120° intervals around the turret. The turret 135 is arranged so that a spindle 137 can be located in the transfer roller cluster when the rollers are in their triangular configuration (FIG. 4). When a transfer is called for, swing arm 120 is pivoted downward so the ropes 118 on the transfer cluster make contact with, and form an arc around the top part of the spindle 137. It will also be appreciated that when the transfer (to be described later) is completed, the second end of swing arm 120 will be lowered to raise roller 116 to the position shown in FIG. 3. At this point, the spindle 137 with the leading edge of the film strip attached will index to the final wind position, while an empty spindle will move into the transfer position. Movement of roller 116 is necessary because in the FIG. 4 position it would interfere with the path of travel of the spindles during the time the turret is rotating.

Figure 4:
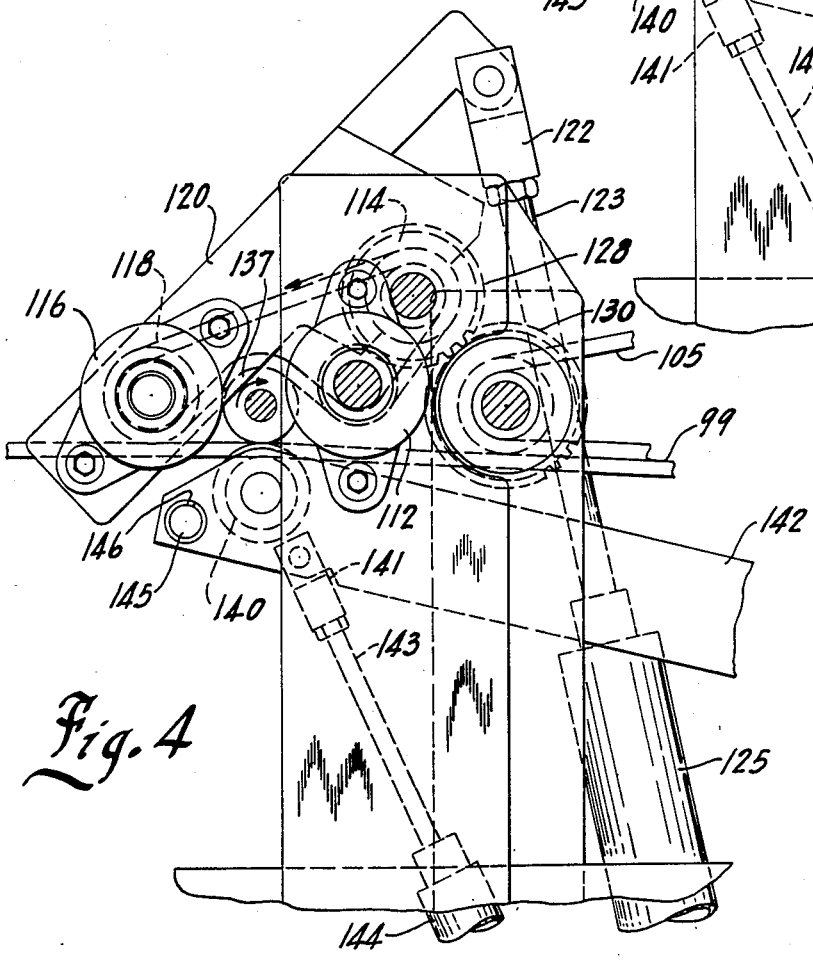
FIG. 4 is a side detail view of the transfer cluster showing a second position for the pivotable roller.

While the transfer cluster is in the transfer position, the air clutch on the shaft of roller 104 is activated to cause rotation of gears 128 and 130 and to cause the ropes 118 to travel in the direction indicated by the arrow in FIG. 4. Also at this point, an override clutch (not shown) on the spindle drive system allows the spindle 137 to be driven at the speed of ropes 118. This overrides the normal drive of the spindles which is accomplished by a double sided timing belt 113 which is driven from a magnetic particle clutch 115. Belt 113 also passes around a tightener roller 117 mounted adjacent the spindle in the final wind position. However, since the transfer is made at the film speed, i.e., the speed of ropes 99, the surface speed of the transfer spindle must match or exceed this film speed. The spindle is therefore driven while at the transfer station by the overspeeded ropes 118 of the transfer cluster.

An elongate plate 142 is pivotably mounted to frame 72 at pivot 111, a portion of which is coupled to a clevis 141 of a piston rod 143 of yet another pneumatic cylinder 144. A roller 140 is rotatably supported in plate 142 and is provided to urge the ropes 99 against the bottom of the spindle in the transfer position to insure proper film transfer. Plate 142 also supports an air pipe 145 having a plurality of air holes 146, so that an air blast can pass through the ropes to cause a lifting of the leading edge of the film strip, thus directing the leading edge into the nip formed between roller 116 and spindle 137. The leading edge will then pass around the spindle 137 and be carried by ropes 118 and be caught in its own nip to facilitate spindle attachment.

After attachment of the film to a spindle 137, indexing of the turret 135 and sequencing of the transfer station 110 occur. At this point the spindle to which the film is attached will rotate clockwise to a wind position as illustrated at 148 in FIG. 2. The arc of travel of the spindle 137 between station 110 and position 148 will be such that the rotating spindle and starting roll 160 of bags will be maintained in contact with ropes 99. It should also be appreciated that it is necessary to maintain rotation of the spindle 137 during rotation of the turret 135 which is accomplished by the aforementioned double-sided timing belt 113. Such spindle rotation is also provided in my prior winder device. However, the arc itself causes an initial increase in tension and subsequent slackness in belt 113, and it is necessary to compensate therefor during turret rotation. This is accomplished by having the belt 113 pass around pulley 117 which in turn is rotatably mounted to a first end of a link 152. The other end of link 152 is pivotably coupled to plate 154 (attached to frame 72) and to the first end of second link 155 extending downwardly therefrom. The second end of link 155 is coupled to the free end of a piston rod 157 of yet another pneumatic cylinder 158. This cylinder then acts to maintain the desired tension in double-sided timing belt 113.

Figure 6A:
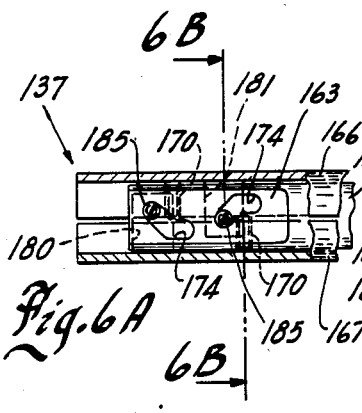
FIG. 6A is a partial side elevation showing the collapsed position of the collapsible spindle employed in the preferred embodiment of the present invention.
Figure 6B:
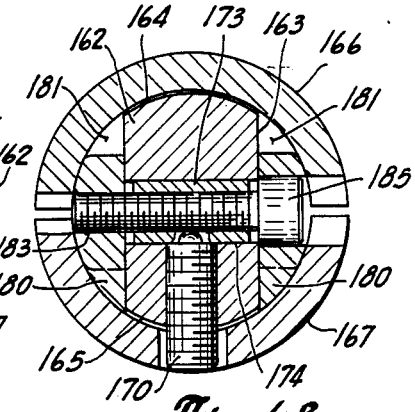
FIG. 6B is a view taken along the line 6B-6B of FIG. 6A illustrating a part of the collapsing mechanism.
Figure 5B:
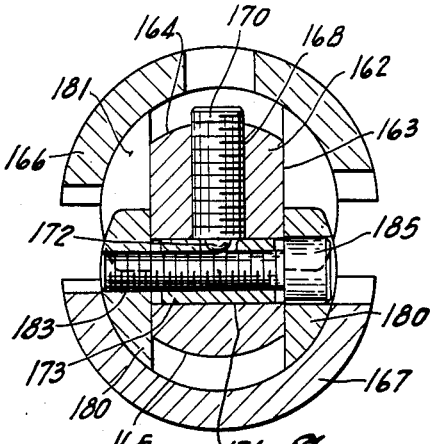
FIG. 5B is a view taken along line 5B-5B of FIG. 5A illustrating a part of the collapsing mechanism.
Figure 5A:
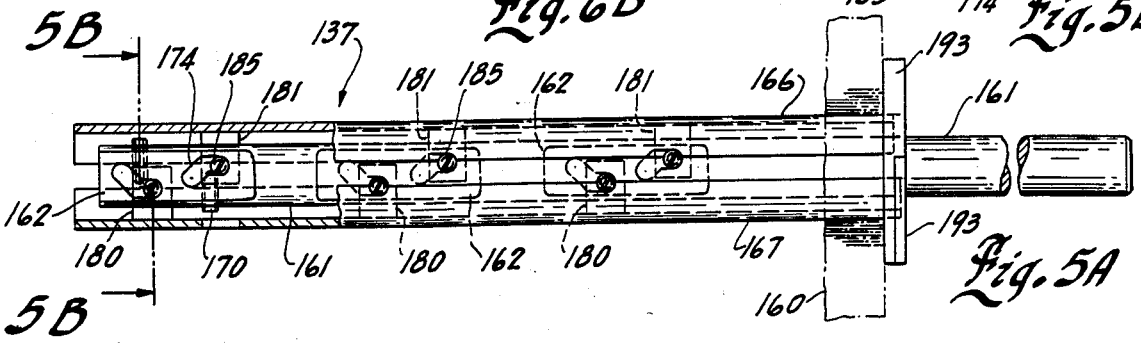
FIG. 5A is a side elevation showing the open position of the collapsible spindle employed in preferred embodiment of the present invention.

FIGS. 5A and 6A illustrate a novel spindle 137 according to the preferred embodiment of the present invention, cross-sectional view thereof being shown in FIG. 5B and 6B. Spindle 137 includes a shaft for driving of the spindle. The shaft includes a round drive end 161 and an inner portion 162 which includes flat sides 163 and rounded top and bottom surfaces 164 and 165 respectively. The gear for engaging timing belt 113 would be attached to portion 161. Portion 162 is surrounded by a pair of elongate, semicircular cylinder shells 166 and 167, having an inside diameter which is slightly larger than the outside diameter of shaft 161. Surfaces 164 and 165 include inwardly extending threaded bores 168 at a plurality of locations along the length of portion 162, bores 168 being in pairs which include one extending inwardly from the top surface 164 and the other extending inwardly from the bottom surface 165. A threaded bolt 170 is provided in each of bores 168, the inward end thereof including a spring-loaded ball bearing 172. The spring is not shown. Portion 162 also includes a plurality of pairs of generally L-shaped openings 174 between the sidewalls 163. The left opening 174 in each pair extends downwardly and to the right and then includes a horizontal part extending further to the right. The right opening 174 in each pair extends upwardly and to the right and then extends further to the right in a horizontal direction as shown in FIGS. 5A and 6A. The bores 168 are located in such a manner that they intersect openings 174 generally at the angle formed by the two parts of each opening and the bolts 170 are inserted so that the ball portion thereof extends into opening 174.

Wedge-shaped plates 181 and 180 are attached respectively to shells 166 and 167, a pair of each plates 180 and 181 being shown in FIGS. 5B and 6B. The plates are mounted on either side of shaft portion 162 and include a bore 183 therein to receive bolts 185 over which a hardened steel bushing 173 rotates. The plates are arranged so that the bolts 185 with bushing 173 may pass through openings 174 and are further arranged so that when in a first position a bolt 185 with bushing 173 extending through a plate 180 will be located at the right end of the opening 174 in the left of one of the opening pairs and so that a bolt 185 with bushing 173 extending through a plate 181 will be located at the right end of the other opening 174 of the opening pair.

From the FIGURES, it will be appreciated then that the shells 166 and 167 will be spaced apart from top and bottom surfaces 164 and 165 when in a first position as in FIG. 5B and will be collapsed against surfaces 164 and 165 when in a second position as in FIG. 6B. The spring-loaded balls 172 will have a tendency to maintain one position or the other unless the spring-loaded forces thereof are overcome.

Movement of the collapsible components of spindle 137 is accomplished in the preferred embodiment of the invention by a push-off palm 190 shown schematically in FIG. 2. Push-off palms themselves are known in the art and do not, in and of themselves, form part of the present invention. It will suffice here to state that palm 190 is a plate movable from a first position in which it is adjacent the face of turret 135 to a second position in which it is extended perpendicularly from such face by a distance sufficient to completely remove the roll 160 from spindle 137.

Because of the unique construction of spindles 137, it is not necessary to provide a mechanical collapsing starter because the film will be wrapped tightly around shells 166 and 167 at the time palm 190 starts its outward movement. At such time the resistance of the palm 190 against the end of the roll 160 will create forces against the spring-loaded balls 172. When such pressure is overcome, the shells 166 and 167 will collapse, thus loosening the inner wraps of the roll 160 to permit easy roll removal.

When the roll has been completely removed, palm 190 will retract and as it approaches the face of turret 135 the palm will contact a plate 193 coupled to the shells and push the shells back to their open position. The shells are "cocked" in this locked position once the resistance of the spring-loaded ball bearings 172 has been overcome. The spindle 137 is then empty and ready to rotate to the transfer position.

A torque dial located at the operator's control panel (not shown) will allow the operator to select the right amount of driving torque for the winding spindle to obtain good roll geometry. Too low a torque drive force will not tighten the inside or inner wraps of the winding roll of bags which will lead to a sloppy or loose roll. Too much torque, on the other hand, could result in tearing the perforations apart between the bags, resulting in waste.

While a variety of control systems and counters can be employed with the present invention, the preferred electrical sequencing is generally the same as with my prior winder, it being understood that the differences at the transfer station and the collapsible spindles form the most important features of the present invention. The mechanical collapsible spindle is more reliable than the air blast tapered spindles of my prior art winder in that the air blast components for the rotating turret have been eliminated. Also, at the transfer station, the cluster of rollers will result in a higher percentage of successful transfers than in the prior art system involving an air horn and kick-roll.

Numerous modifications can be made to the present invention and still fall within the intended scope hereof. For example, hydraulic cylinder systems could be substituted for the pneumatic cylinders which are illustrated. Moreover, the clutch and drive systems for the various rollers and for the turret could be variously embodied by one skilled in the art after reading the present specification. So while the present invention has been described in connection with a particular preferred embodiment, it is not to be limited thereby but is to be limited solely by the scope of the claims which follow.

I claim:

1. A winder for winding elongate strips of pliable material into coreless cylindrical rolls, said winder including:

winding assembly means including a plurality of spindle means, each of which includes elongate, collapsible shell elements movable between a first open position and a second collapsed position, and a push plate adjacent said spindle means movable between a first retracted position and a second extended position;

conveyor means for conveying said strips of pliable material to said winding assembly means;

transfer means for transferring the leading edge of said strips of pliable material from said conveyor means to one of said spindle means;

means for driving said conveyor means;

means for driving said transfer means and means for driving the spindle means and push plate of said winding assembly means; and wherein when one of said rolls has been wound onto one of said spindle means, said push plate moves from said first retracted position to said second extended position thereby encountering a planar side of said roll, thereby frictionally moving said spindle means from said first open position to said second collapsed position.

2. The winder set forth in claim 1 wherein said winding assembly means further comprises a generally round rotatable turret means, at least three of said spindle means extending perpendicularly therefrom and being arranged equidistant from one another about the periphery of said turret means.

3. The winder set forth in claim 2 wherein each of said spindle means comprises an axially stationary and rotatable shaft surrounded by said elongate collapsible shell elements.

4. The winder set forth in claim 3 wherein each of said elongate shell elements includes a plurality of wedge-shaped plates mounted to the inside walls of said shell elements, and bolt means attached to and extending between said plates.

5. The winder set forth in claim 4 wherein each of said elongate shell elements is semicircular in cross-section.

6. The winder set forth in claim 5 wherein said rotatable shaft contains a plurality of L-shaped slots therethrough, said L-shaped slots allowing said bolt means to slidably move therein, and said L-shaped slots being oriented such that the first end of each of said slots is longitudinally closer to said turret and radially further from the axis of said shaft than the second end of said slot and such that when said elongate shell elements are in said first open position, said bolt means rest in the first end of said L-shaped slots and when said elongate shell elements are in said second collapsed position, said bolt means rest in the second end of said L-shaped slots.

7. The winder set forth in claim 4 wherein said bolt means are surrounded by cylindrical bushing means.

8. The winder set forth in claim 7 wherein said pliable material is a plastic film and said transfer means comprises a plurality of rollers coupled by drive ropes, a first roller of said plurality of rollers being movable between a first position and a second transfer position; said drive ropes contacting said spindle means to effectuate transfer of said plastic film from said conveying means to said spindle means when said first roller is in said second transfer position.

9. The winder set forth in claim 8 wherein said transfer means further comprises an air pipe for directing air jets to initiate winding of the plastic film by lifting it off of the conveying means and directing it into the nip between said first roller of said plurality of rollers and said spindle.

10. The winder set forth in claim 9 wherein movement of said first roller of said plurality of rollers from said first position to said second transfer position is accomplished by mounting said first roller on a pivotable swing arm.

11. The winder set forth on claim 10 wherein said swing arm is connected to a pneumatic cylinder.

12. The winder set forth in claim 11 wherein said plurality of rollers consists of three rollers.

13. The winder set forth in claim 12 wherein said three rollers are in a generally linear configuration when said first roller is in said first position and are in a generally triangular configuration when said first roller is in said second transfer position.

14. The winder set forth in claim 13 wherein said plastic film comprises a strip of at least partially-connected plastic bags.

15. A winder for winding strips of plastic film into coreless rolls, said winder comprising:

winding assembly means comprising a plurality of spindle means, each spindle means having a surface onto which the plastic film may be wound;

conveying means for conveying said strips of plastic film to said winding assembly means;

transfer means for transferring the leading edge of said strip of plastic film from said conveyor means to one of said spindle means, said transfer means consisting essentially of three rollers coupled by drive ropes, a first roller of said rollers being movable between a first position and a second transfer position, wherein said three rollers are in a generally linear configuration when said first roller is in said said first position and are in a generally triangular configuration when said first roller is in said second transfer position, the other two of said rollers being stationary, said drive ropes contacting a large portion of the surface of said spindle means to effectuate transfer of the plastic film from said conveying means to said spindle means when said first roller is in said second transfer position;

means for driving said conveyor means;

means for driving said transfer means and means for driving the spindle means of said winding assembly means.

16. The winder set forth in claim 15 wherein said transfer means further comprises an air pipe for directing air jets to initiate winding of the plastic film by lifting it off of the conveying means and directing it into the nip between said first roller of said plurality of rollers and said spindle.

17. The winder set forth in claim 16 wherein movement of said first roller of said plurality of rollers from said first position to said second transfer position is accomplished by mounting said first roller on a pivotable swing arm.

18. The winder set forth in claim 17 wherein said swing arm is connected to a pneumatic cylinder.

19. A winder for winding elongate strips of pliable material into coreless rolls, said winder including:

(1) winding assembly means comprising (a) a generally round rotatable turret means and at least three spindle means extending perpendicularly therefrom and being arranged equidistant from one another about the periphery of said turret means, and (b) each spindle means of said plurality of spindle means including (i) elongate, collapsible shell elements semicircular in cross-section having a plurality of wedge-shaped plates mounted to the inside walls of said shell elements and bolt means attached to and extending between said plates, said shell elements being movable between a first open position and a second collapsed position, and (ii) a rotatable shaft surrounded by said shell elements containing a plurality of L-shaped slots therethrough, said L-shaped slots allowing said bolt means to slidably move therein, and said L-shaped slots being oriented such that the first end of each of said slots is longitudinally closer to said turret and radially further from the axis of said shaft than the second end of said slot and such that when said elongate shell elements are in said first open position, said bolt means rest in the first end of said L-shaped slots and when said elongate shell elements are in said second collapsed position, said bolt means rest in the second end of said L-shaped slots, and (2) conveyor means for conveying said strips of pliable material to said winding assembly means;

(3) transfer means for transferring the leading edge of said strips of pliable material from said conveyor means to one of said spindle means;

(4) means for driving said conveyor means;

(5) means for driving said transfer means and means for driving said spindle means of said winding assembly means.

* * * * *